US006872090B2

(12) United States Patent
De Dios Martin

(10) Patent No.: US 6,872,090 B2
(45) Date of Patent: Mar. 29, 2005

(54) CABLE TERMINATING APPARATUS AND METHOD

(75) Inventor: Longinos De Dios Martin, Barcelona (ES)

(73) Assignee: Tyco Electronics AMP Espana, S.A., Barcelona (ES)

( * ) Notice: Subject to any disclaimer, the term of this patent is extended or adjusted under 35 U.S.C. 154(b) by 0 days.

(21) Appl. No.: 10/717,077

(22) Filed: Nov. 19, 2003

(65) Prior Publication Data

US 2004/0137784 A1 Jul. 15, 2004

(30) Foreign Application Priority Data

Nov. 19, 2002 (EP) ..... 02257956

(51) Int. Cl.[7] ..... H01R 4/24
(52) U.S. Cl. ..... 439/417
(58) Field of Search ..... 439/417, 467, 439/465, 466, 457; 29/750, 751, 752, 758

(56) References Cited

U.S. PATENT DOCUMENTS 4,180,904 A 1/1980 Nijman ..... 29/749
4,972,575 A * 11/1990 Frantz et al. ..... 29/858
5,457,876 A 10/1995 Gerhard, Jr. ..... 29/751
5,624,274 A * 4/1997 Lin ..... 439/417
5,832,603 A 11/1998 Fallandy ..... 29/861
6,267,617 B1 * 7/2001 Nozick ..... 439/417

OTHER PUBLICATIONS

Abstract; European Patent Office; app. date Oct. 21, 1996; app. No. 8277989; Wire Connecting Tool.

European Search Report; app. No. EP 02 25 7956; date completed Apr. 7, 2003.

* cited by examiner

*Primary Examiner*—Ross Gushi
(74) *Attorney, Agent, or Firm*—Barley, Snyder, Senft & Cohen, LLC

(57) ABSTRACT

A cable terminating apparatus for terminating a cable having a plurality of wires with a connector, the cable terminating apparatus includes a housing having a plurality of slots arranged for positioning the plurality of wires in a fixed spaced relationship relative to each other. A connector has a plurality of terminals corresponding to the plurality of wires. A squeezing tool has a recess configured for receiving the housing and the connector. The squeezing tool has a moveable plate for urging the connector and the housing against a support wall and into engagement with each other to electrically connect the plurality of terminals with the plurality of wires.

22 Claims, 8 Drawing Sheets

CABLE TERMINATING APPARATUS AND METHOD

FIELD OF THE INVENTION

The invention relates to an apparatus and method for terminating an electrical cable with a connector.

BACKGROUND OF THE INVENTION

To terminate a cable containing a plurality of wires with a connector containing a plurality of terminals, such as, a cable used for telecommunication applications, each of the wires is inserted one at a time into each of the terminals with a tool made of plastic. The wires are then pressed into engagement with the terminals and free ends of the wires are removed with a tool, such as pliers. This conventional method of termination, however, is difficult to perform and has several drawbacks, particularly in instances where the cable contains a significant number of small diameter wires. For example, the method of cutting the free ends of the wires with pliers results in the free ends having variable lengths. Because the length of the free ends is inconsistent, the free ends may come into contact with a metal shielding member. Additionally, because the tools are made of plastic, the tools are not durable.

SUMMARY OF THE INVENTION

It is, therefore, an object of the invention to provide a method and device that facilitates the termination of a cable having a plurality of wires with a connector having a plurality of terminals. It is another object of the invention to provide a method and device that cuts wire ends proximate to terminals of the connector in a convenient manner and ensures that the wire ends are removed from the connector in such a way that the wire ends do not protrude from the connector and impede the application of a strain relief member to the connector. It is still a further object of the invention to provide a method and device that inserts the wires into terminals of the connector to a uniform controlled depth.

This and other objects are solved by a cable holding device for terminating a cable having a plurality of wires with a connector comprising a housing having a plurality of slots arranged for positioning the plurality of wires in a fixed spaced relationship relative to each other, and an inner surface configured for guiding a complementary surface of the connector into electrical engagement with the plurality of wires.

This and other objects are further solved by a cable terminating apparatus for terminating a cable having a plurality of wires with a connector. The cable terminating apparatus includes a housing having a plurality of slots arranged for positioning the plurality of wires in a fixed spaced relationship relative to each other. A connector has a plurality of terminals corresponding to the plurality of wires. A squeezing tool has a recess configured for receiving the housing and the connector. The squeezing tool has a moveable plate for urging the connector and the housing against a support wall and into engagement with each other to electrically connect the plurality of terminals with the plurality of wires.

This and other objects are further solved by a method of terminating a cable having a plurality of wires with a connector having a plurality of terminals wherein the plurality of wires are positioned in a housing in a fixed spaced relationship relative to each other. A connector is aligned with the housing by engaging an inner surface of the housing with a complementary surface of the connector. The connector and the housing are pressed against a support wall to urge the connector further into engagement with the housing to electrically connect the plurality of terminals with the plurality of wires. Free ends of the plurality of wires are simultaneously severed with a cutting device.

BRIEF DESCRIPTION OF THE DRAWINGS

The invention will now be described by way of example only with reference to the accompanying drawings, in which.

DETAILED DESCRIPTION OF THE INVENTION

Figure 1:
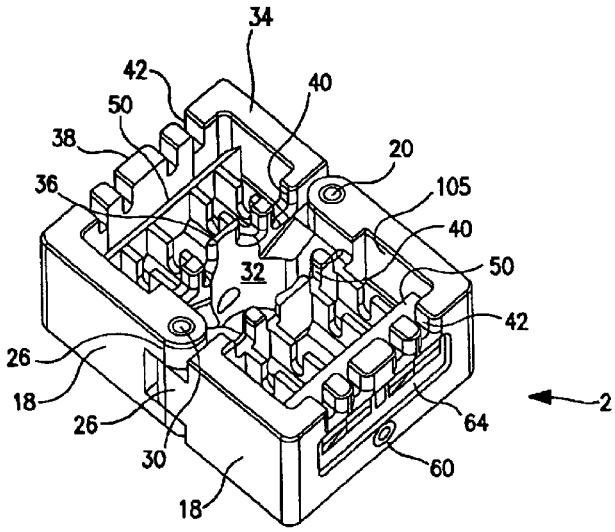
FIG. 1 is a top perspective view of a cable holding device of the present invention.
Figure 2:
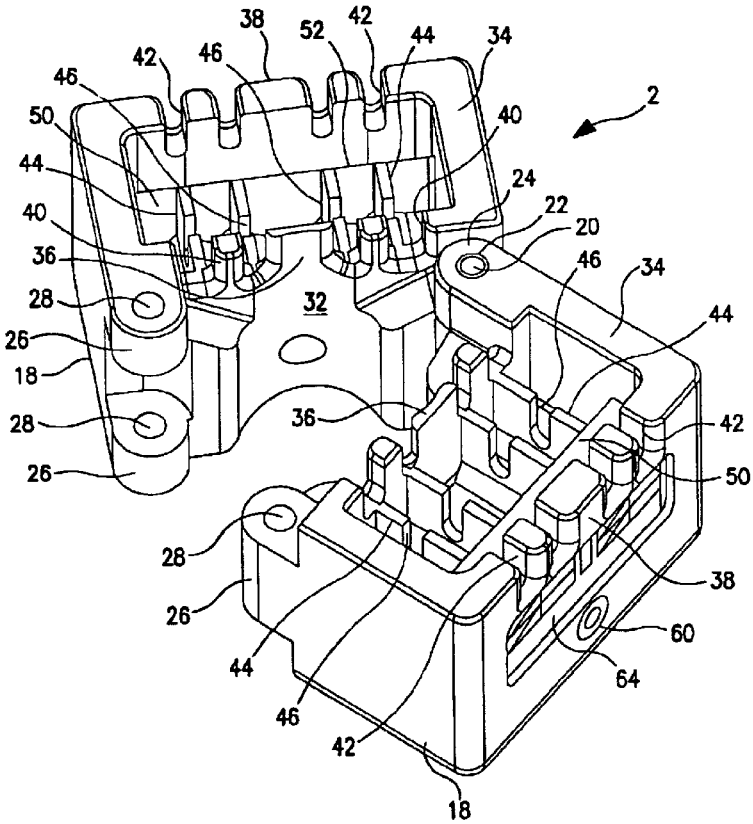
FIG. 2 is a top perspective view of the cable holding device in an open state.
Figure 9:
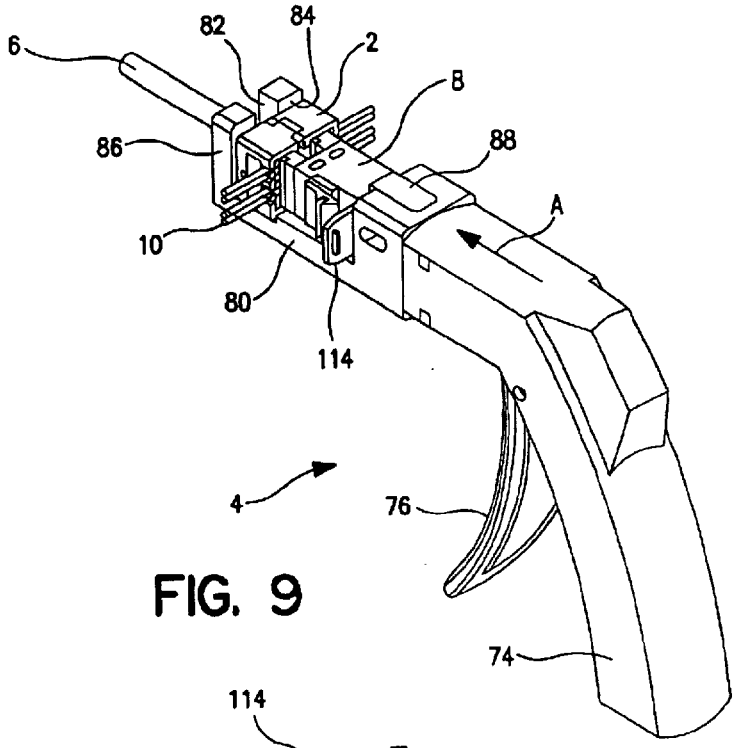
FIG. 9 is a perspective view of the cable holding device and the connector loaded into a squeezing tool.

FIG. 9 shows a cable terminating apparatus according to the invention. The apparatus includes a cable holding device 2 and a squeezing tool 4 for terminating a cable 6 with a connector 8. As shown in FIGS. 1 and 2, the cable holding device 2 may be formed from metal and includes a housing having first and second housing parts 18. Hinge lugs 24 project from the first and second housing parts 18. Each of the hinge lugs 24 has a through-hole 22. The through-holes 22 are aligned for receipt of a pivot pin 20 to hingeably mount the first housing part 18 to the second housing part 18 such that the first and second housing parts 18 may be rotated between an open position shown in FIG. 2 and a closed position shown in FIG. 1. Locking lugs 26 are formed on a side opposite from the hinge lugs 24. Each of the locking lugs 26 has a through-hole 28. The through-holes 28 are aligned for receipt of a locking pin 30 that secures the first and second housing parts 2 in the closed position.

Figure 5:
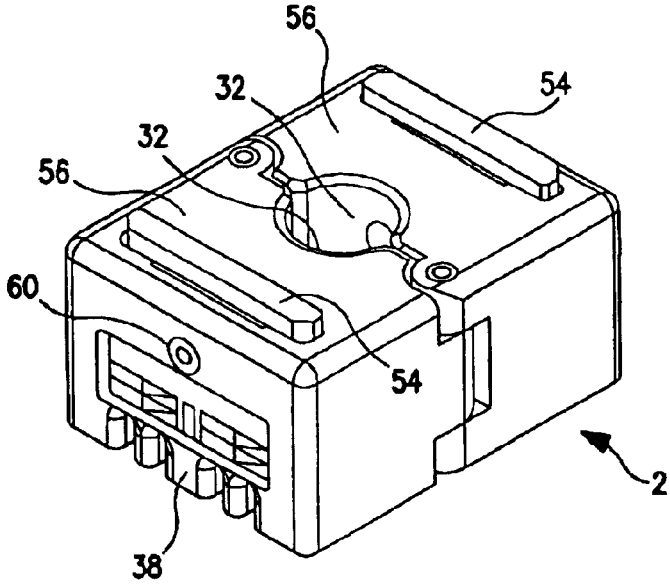
FIG. 5 is a bottom perspective view of the cable holding device.

Between the hinge lugs 24 and the locking lugs 26, each of the first and second housing parts 18 has a hemi-cylindrical cable gripping recess 32, as best shown in FIG. 5. As shown in FIG. 2, each of the cable gripping recess 32 is defined by an inner side wall 36 having U-shaped inner wall slots 40 for guiding or lacing wires 10 of a cable 6. The inner wall slots 40 open toward a front end 34 of the first and second housing parts 18. An opposite or outer side of each of the first and second housing parts 18 is defined by an. outer side wall 38 that includes outer wall slots 42 for guiding or lacing the wires 10 of the cable 6. The outer wall slots 42 open toward the front end 34 of the first and second housing part 18. Each of the inner wall slots 40 is aligned with a corresponding outer wall slot 42. The inner and outer wall slots 40, 42 have a width that snugly accommodates the wire 10 and its insulation covering. Wire support structures 44 extend perpendicularly to the inner and outer side walls 36, 38 and adjacent to each pair of the inner and outer wall slots 40, 42. Each of the wire support structures 44 includes a U-shaped slot 46 for receiving a terminal, such as an insulation displacement terminal 14, as described in more detail below.

As shown in FIG. 1, an indicator panel 64 extends along each of the outer side walls 38 and adjacent to the outer wall slots 42. The indicator panel 64 includes indicia corresponding to colors of the insulation covering of the wires 10 to designate which of the wires 10 is to be inserted into each of the outer wall slots 42.

Figure 3:
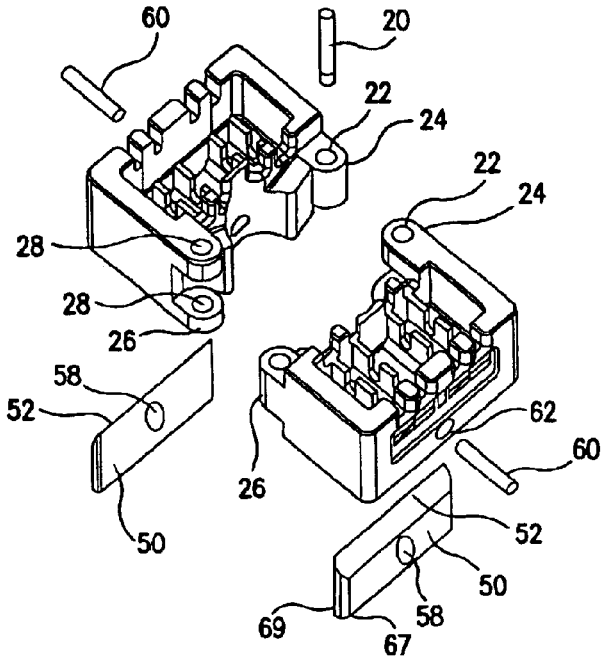
FIG. 3 is an exploded perspective view of the cable holding device.
Figure 4:
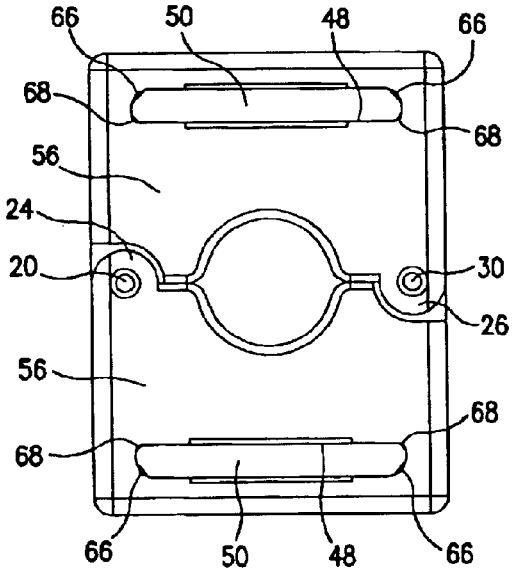
FIG. 4 is a bottom plan view of the cable holding device.
Figure 6:
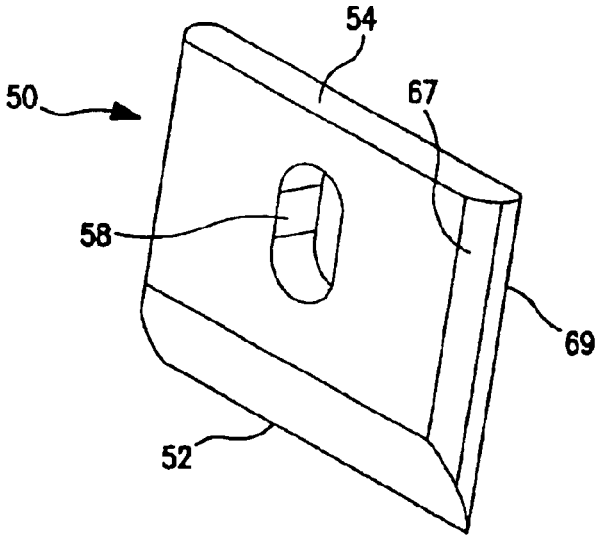
FIG. 6 is a perspective view of a cutting blade of the cable holding device.

As shown in FIG. 4, each of the first and second housing parts 18 includes a blade slot 48 positioned close to and parallel to each of the outer side walls 38. An end of each of the blade slots 48 has a first curved portion 66 with a relatively large radius of curvature and a second curved portion 68 with a relatively small radius of curvature. As shown in FIGS. 5 and 6, a cutting device, such as a blade 50 having a cutting edge 52, is slidably received in each of the blade slots 48. The cutting edge 52 is formed so that when a rear end 54 of the blade 40 is moved flush with a rear face 56 of the corresponding first or second housing part 18, the cutting edge 52 severs the wires 10 extending through the wire guiding slots 42. As shown in FIG. 3, sides of the blades 50 have first and second radiused portions 67, 69 that correspond with the first and second curved portions 66, 68. The first and second radiused portions 67, 69 ensure that the blades 50 can only be installed in one direction so that when the cutting edge 52 cuts the wires 10, a minimal amount of the cutting edge 52 projects through terminals 14 in the connector 8.

As shown in FIG. 3, a blade retainer 60 that is formed as a slotted spring pin is force fitted in an aperture 62 in the outer side walls 38 of each of the first and second housing parts 18. The blade retainer 60 passes through an elongated aperture 58 in the blade 50 and prevents the blade 50 from becoming detached from the first and second housing parts 18. The elongated aperture 58 is configured so that the blade 50 can slide toward and away from the front end 34 of the cable holding device 2.

Figure 8:
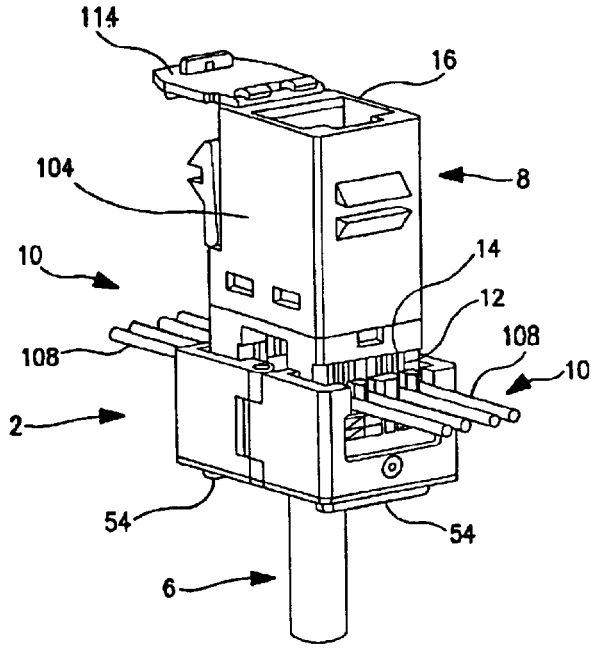
FIG. 8 is a perspective view of the cable holding device of FIG. 7 partly engaged with a connector.

As shown in FIG. 8, the connector has a connector body 104 having a mating face 16 that receives a complimentary connector (not shown) and a connection face 100. The mating face 16 may include a dust cover 114. The connection face 100 is provided with a plurality of insulation displacement terminals 14. Each of the terminals 14 has a corresponding insulation displacement slot 12. Opposite ends of the terminals 14 are positioned so as to be engageable from the mating face 16 of the connector 8 by means of the complementary connector (not shown).

Figure 10:
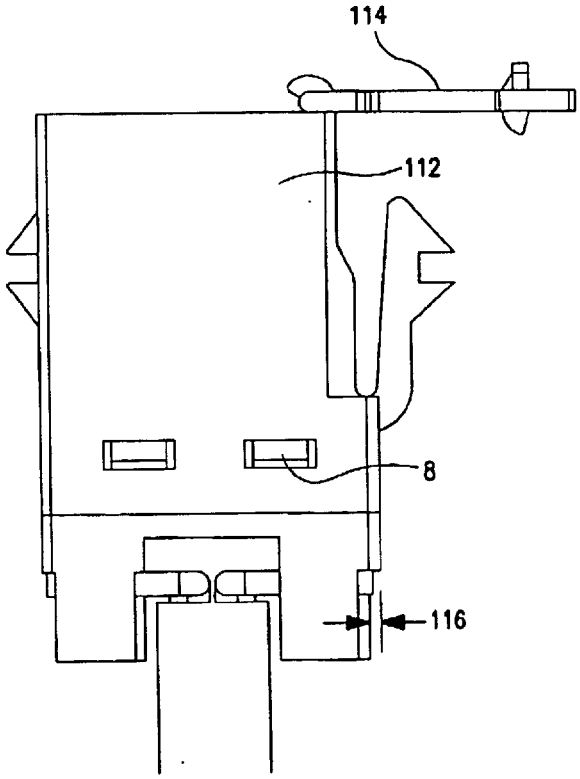
FIG. 10 is a plan view of the connector with a metal shielding member.

As shown in FIG. 10 and as is well known in the art, a metal shielding member 112 may be folded around the connector 8. An outer surface of the metal shielding member 112 is configured to project a distance 116 of 0.5 mm outside an outer surface of the connector body 104.

Figure 11:
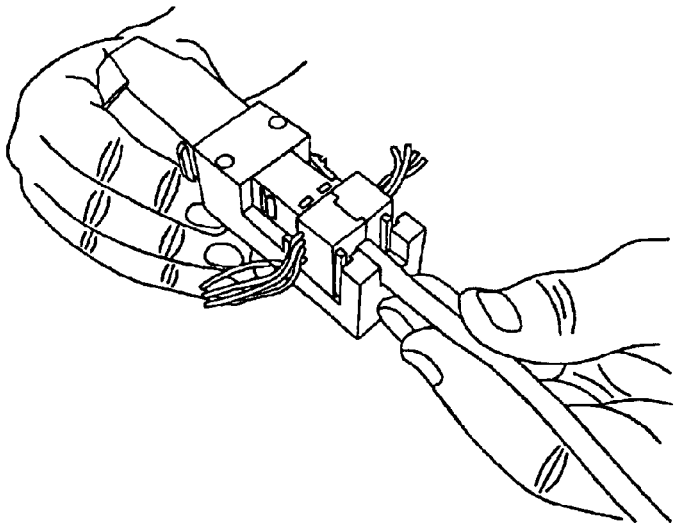
FIG. 11 is a perspective view of the cable holding device and the connector being loaded into the squeezing tool.
Figure 12:
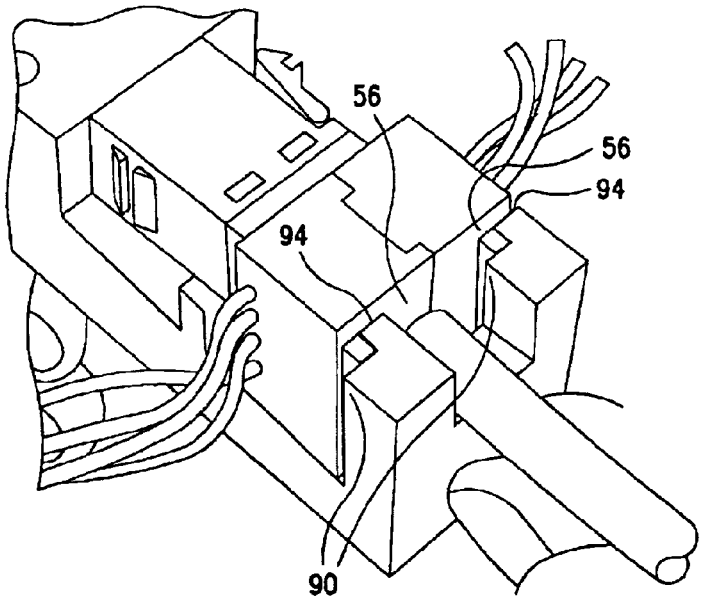
FIG. 12 is a perspective view of the cable holding device relative to the squeezing tool during a first squeezing operation.
Figure 13:
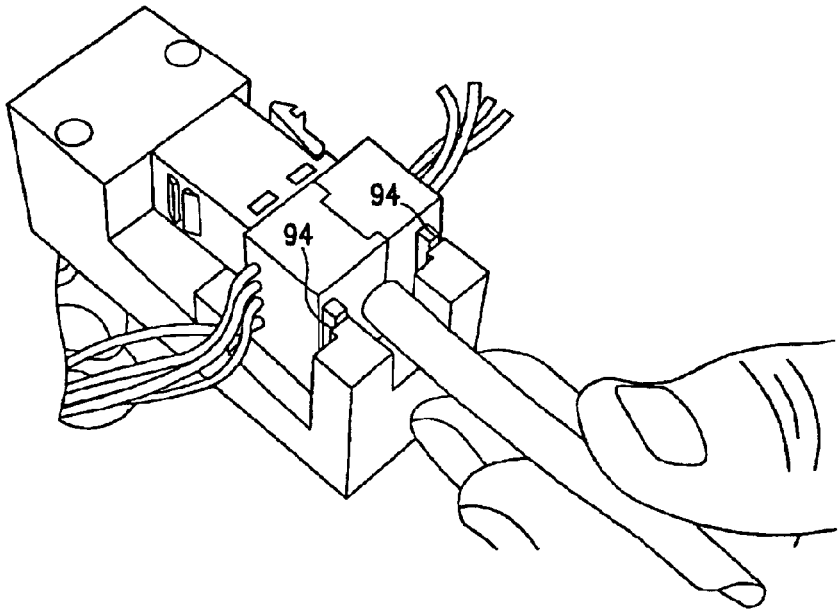
FIG. 13 is a perspective view of the cable holding device relative to the squeezing tool during a second squeezing operation.

As shown in FIG. 9, the squeezing tool 4 may be made from metal and includes a handle 74 connected to a trigger 76 by a pivot pin (not shown). Projecting forwardly from the handle 74 is a frame 80. The frame 80 has a U-shaped recess 84 configured to receive the cable holding device 2 and the connector 8, as described in more detail below. The frame 80 of the squeezing tool 4 may be adapted to be used with a connector with or without the dust cover 114. A moveable. plate 88 is mounted in a proximal end of the frame 80 and is displaceable into the recess 84 in a direction shown by arrow A by movement of the trigger 76 towards the handle 74. A distal end of the frame 80 is a support wall 86 that has a U-shaped slot 82 opening toward a top surface of the frame 80. The slot 82 is configured to receive the cable 6 and has a width significantly larger than a diameter of the cable 6, as best shown in FIGS. 11–13. As shown in FIG. 12, a proximal face of the support wall 86 has rebated portions 90 dimensioned to receive the rear ends 54 of the blades 50 when the cable holding device 2 is in a first lateral position relative to the frame 80. A space formed between the rebated portions 90 correspond to the space between the blades 50. Laterally adjacent to and on the same side as each of the rebated portions 90 is a support face 94. The lateral distance between adjacent support faces 94 is the same as the distance between the blades 50.

Figure 7:
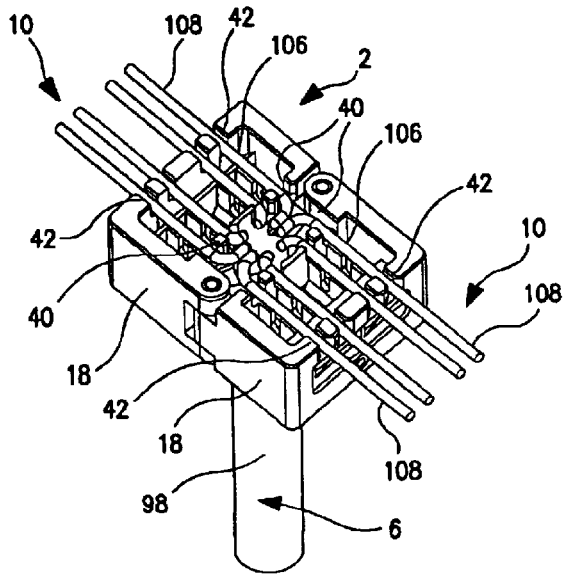
FIG. 7 is a perspective view of the cable holding device with a cable installed therein.
Figure 16:
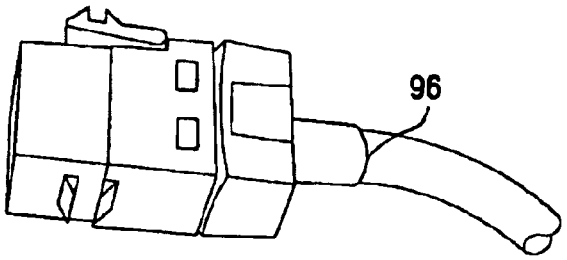
FIG. 16 is a perspective view of the cable terminated with the connector and a strain relief device.

The method of terminating the cable 6 with the connector 8 using the cable holding device 2 and the squeezing tool 4 will now be described in greater detail. As shown in FIG. 16, a strain relief member 96 is slipped over an end of the cable 6. An outer insulation 98 of the cable 6 is stripped to expose an insulation covering of the wires 10 of the cable 6, as shown in FIG. 7. The locking pin 30 is removed from the cable holding device 2 so that the cable holding device 2 may be pivoted to the open position, as shown in FIG. 2. The cable 6 is inserted into the cable holding device 2, and the cable holding device 2 is closed about the cable 6 so that an end portion of the outer insulation 98 is clamped between the cable recesses 32 of the first and second housing parts 18. The locking pin 30 is re-inserted to secure the first and second housing parts 18 in the closed position such that the cable 6 is firmly gripped in the cable holding device 2.

As shown in FIG. 7, each of the wires 10 is laced through one of the inner wall slots 40 in the inner side walls 36 and through the corresponding outer wall slots 42 in the outer side walls 38 according to the indicia on the indicator panel 64. As the wires 10 are laced, the blades 50 may be inserted into the first and second housing parts 18 so that the rear ends 54 of the blades 50 project from the rear face 56 of the cable holding device 2. Alternatively, the blades 50 may be inserted into the first and second housing parts 18 prior to installing the cable 6 in the cable holding device 2.

As shown in FIG. 8, the connector 8 used to terminate the cable 6 is partially engaged with the wires 10 by pushing the connection end 100 slightly into the cable holding device 2. An outer surface of the connector body 104 engages the inner surfaces 105 of the first and second housing parts 18 thereby aligning the terminals 14 with contact portions 106

(FIG. 7) of the wires 10. As this occurs, the contact portions 106 of each of the wires 10 enter a distal portion of the corresponding insulation displacement slots 12. The connector body 104 and the internal structure of the cable holding device 2 may be formed so that the connector 8 may only be engaged with the cable holding device 2 in one orientation. Alternatively, the cable holding device 2 may bear a label or other indicator for showing the correct orientation for engagement of the connector 8 with the cable holding device 2.

As shown in FIGS. 9 and 11–12, the cable holding device 2 and the connector 8 are then placed in the recess 84 of the squeezing tool 4 with the rear face 56 of the cable holding device 2 facing the support face 94 of the support wall 86 of the frame 80. When the cable holding device 2 and the connector 8 are placed in the squeezing tool 4, the moveable plate 88 is in a retracted position (moved towards the handle 74). The cable 6 is moved laterally in the slot 82 to the position shown in FIG. 11 where the rear ends 54 of the blades 50 are aligned with the rebated portions 90 in the support wall 86. The connector 8 and the cable holding device 2 are then moved to insert the rear ends 54 of the blades 50 into the rebated portions 90, as shown in FIG. 12. The frame 80 may be configured such that the connector 8 and cable holding device 2 may only be placed in the squeezing tool 4 in one orientation.

The trigger 76 is squeezed so that the moveable plate 88 moves in the direction of the arrow A and forces the connector 8 fully into engagement with the cable holding device 2. As the connector 8 is engaged with the cable holding device 2, each of the wires 10 is pushed into the displacement slots 12 and into the insulation displacement terminals 14 associated therewith. The support structures 44 that are arranged adjacent to the contact portions 106 of each of the wires 10 assist in pushing the wires 10 into the insulation displacement terminals 14. The cable holding device 2 is prevented from moving distally from the frame 80 by the rear face 56 bearing on the support faces 94 of the support wall 86. Because the rear ends 54 of the blades 50 are accommodated in the rebated portions 90, no force is applied to the blades 50.

The trigger 76 is released and the cable holding device 2 and the connector 8 are moved proximally by a small distance so that the connector 8 and the cable holding device 2 may be laterally displaced to the position shown in FIG. 13 where the rear ends 54 of the blades 50 are aligned with the support faces 94. The trigger 76 is then squeezed again so that the moveable plate 88 displaces the cable holding device 2 and the connector 8 distally in the frame 80. As this occurs, the rear ends 54 of the blades 50 are forced into alignment with the rear faces 56 of the cable holding device 2, and the cutting edges 52 of the blades 50 sever free ends 108 (FIG. 7) of the wires 10 to leave only a minimum amount of the wire 10 projecting outwardly from each of the insulation displacement terminals 14. The free ends 108 of the wires 10, which have been severed, are retained in the guiding slots 42 of the cable holding device 2 and may be pulled-out therefrom for disposal.

Figure 14:
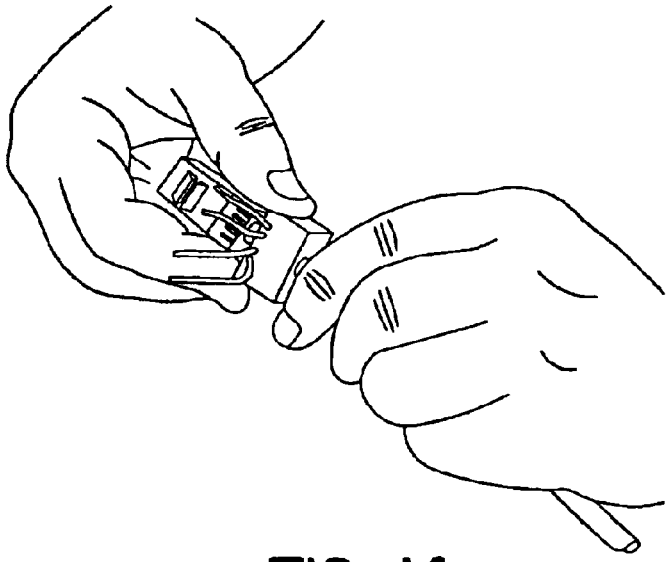
FIG. 14 is a perspective view of the separation of the cable holding device from the connector.
Figure 15:
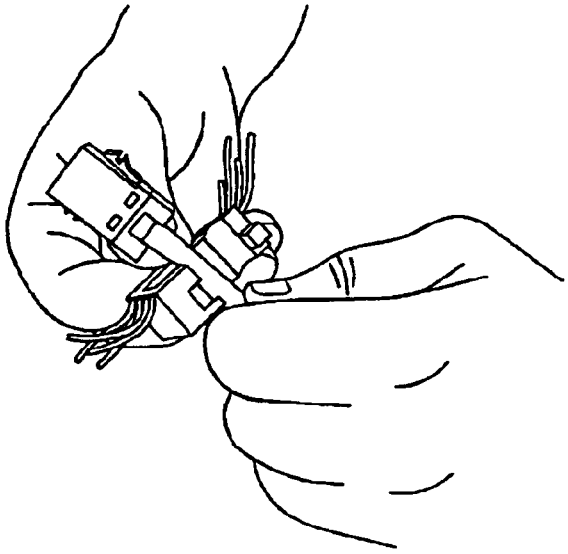
FIG. 15 is a perspective view of the disengagement of the cable holding device from the cable.

The trigger 76 is released, and the cable holding device 2 and the connector 8 are removed from the squeezing tool 4, as shown in FIG. 14. The terminated cable 6 is removed from the cable holding device 2 by removing the locking pin 30 and pivoting the first and second housing parts 18 to the open position, as shown in FIG. 15. The strain relief member 110 is then slid up the cable 6 and over the connection end 100 of the connector 8, as shown in FIG. 16. This operation is facilitated by the fact that the free ends 108 of the wires 10 have been severed close to the connector 8.

Alternatively, the termination of the cable 6 to the connector 8 may be performed in a single step by omitting the steps shown in FIGS. 11 and 12 and by directly placing the cable holding device 2 in the squeezing tool 4 in the manner shown in FIG. 13.

The cable terminating apparatus of the invention is preferably adapted to terminate a cable with a shielded or unshielded SL series 110 connector modular jack. Although the cable 6 in the illustrated embodiment is shown as having eight wires, the cable 6 may have any number of wires, and the cable holding device 2 may be adapted to receive any number of wires and the connector 8 may be adapted to have any number of terminals. Additionally, more than one wire could be inserted into a particular terminal and/or not all terminals may be engaged by a wire. Because the cable holding device 2 and/or the squeezing tool 4 is made of metal, the cable holding device 2 and/or the squeezing tool 4 is durable and can withstand repeated use, and the use of the apparatus leads to a very low rejection rate.

I claim:

1. A cable holding device for terminating a cable having a plurality of wires with a connector, the cable holding device comprising:

a housing having a plurality of slots arranged for positioning the plurality of wires in a fixed spaced relationship relative to each other and an inner surface configured for guiding a complementary surface of the connector into electrical engagement with the plurality of wires, the slots being formed on inner and outer walls of the housing, each of the slots on the outer walls corresponding with one of the slots on the inner walls to form a wire receiving path therebetween; and a cutting device arranged proximate the outer walls for severing free ends of the plurality of wires.

2. The device according to claim 1, wherein the cutting device is arranged parallel to the outer walls.

3. The device according to claim 1, wherein the cutting device includes at least one blade configured to sever the plurality of wires substantially simultaneously.

4. The device according to claim 1, wherein the cutting device is movable from a non-cutting position to a cutting position by an end of the cutting device that projects from the housing.

5. The device according to claim 1, wherein the cutting device is mounted in the housing by a pin that is received in an elongated aperture formed in the cutting device.

6. The device according to claim 1, further comprising an indicator panel arranged adjacent to the wire receiving path to designate which one of the plurality of wires is to be received in the wire receiving path.

7. The device according to claim 1, further comprising a wire support structure arranged between the inner and outer walls of the housing and substantially aligned with the wire receiving path.

8. The device according to claim 7, wherein the wire support structure includes a u-shaped slot arranged for receiving a terminal of the connector.

9. The device according to claim 1, wherein the housing includes first and second housing parts configured to receive the cable therebetween to clamp the cable in the housing.

10. The device according to claim 9, wherein the first and second housing parts are connected via a hinge so that the first and second housing parts pivot between an open position and a closed position.

11. A cable terminating apparatus for terminating a cable having a plurality of wires with a connector, the cable terminating apparatus comprising:

a housing having a plurality of slots arranged for positioning the plurality of wires in a fixed spaced relationship relative to each other;

a connector having a plurality of terminals corresponding to the plurality of wires;

a squeezing tool having a recess configured for receiving the housing and the connector, the squeezing tool having a moveable plate for urging the connector and the housing against a support wall and into engagement with each other to electrically connect the plurality of terminals with the plurality of wires; and a cutting device arranged in the housing, the cutting device having an end portion that projects from the housing and engages the support wall to cause the cutting device to sever free ends of the plurality of wires.

12. The apparatus according to claim 11, wherein the cutting device includes at least one blade configured to sever the plurality of wires substantially simultaneously.

13. The apparatus according to claim 11, wherein the cutting device is mounted in the housing by a pin that is received in an elongated aperture formed in the cutting device.

14. The apparatus according to claim 11, wherein the support wall includes a rebated portion configured for receiving the end portion of the cutting device so that the cutting device does not sever the free ends during engagement of the connector with the cable holding device.

15. The apparatus according to claim 11, wherein the slots are formed on inner and outer walls of the housing, each of the slots on the outer walls corresponds with one of the slots on the inner walls to form a wire receiving path therebetween.

16. The apparatus according to claim 15, further comprising a wire support structure arranged between the inner and outer walls of the housing and substantially aligned with the wire receiving path.

17. The apparatus according to claim 16, wherein the wire support structure includes a u-shaped slot arranged for receiving a terminal of the connector.

18. The apparatus according to claim 15, wherein the cutting device is arranged proximate the outer walls.

19. The apparatus according to claim 18, wherein the cutting device is arranged parallel to the outer walls.

20. A method of terminating a cable having a plurality of wires with a connector having a plurality of terminals, comprising:

positioning the plurality of wires in a housing in a fixed spaced relationship relative to each other;

aligning the connector with the housing by engaging an inner surface of the housing with a complementary surface of the connector;

pressing the connector and the housing against a support wall to urge the connector further into engagement with the housing to electrically connect the plurality of terminals with the plurality of wires;

severing free ends of the plurality of wires simultaneously with a cutting device; and pressing an end portion of the cutting device that projects from the housing toward the housing so that a blade of the cutting device engages the plurality of wires.

21. The method according to claim 20, further comprising placing the connector and the housing in a squeezing tool.

22. The method according to claim 20, further comprising positioning the end portion of the cutting device adjacent to the support wall.

* * * * *